United States Patent [19]

Onuki et al.

[11] 4,426,968

[45] Jan. 24, 1984

[54] CARBURETOR WITH MEANS FOR COMPENSATION OF IDLING REVOLUTION

[75] Inventors: Keiichi Onuki, Hitachi; Tooru Nakagawa, Mito; Tadashi Inoue, Katuta, all of Japan

[73] Assignee: Hitachi, Ltd., Tokyo, Japan

[21] Appl. No.: 297,406

[22] Filed: Aug. 28, 1981

[30] Foreign Application Priority Data

Sep. 5, 1980 [JP] Japan ..... 55-123070

[51] Int. Cl.[3] ..... F02M 11/00; F02M 3/06

[52] U.S. Cl. ..... 123/339; 123/585

[58] Field of Search ..... 123/339, 352, 360, 585; 261/65, 41 D, DIG. 19

[56] References Cited

U.S. PATENT DOCUMENTS 4,253,437 3/1981 Haramoto ..... 123/339
4,300,501 11/1981 Suzuki ..... 123/339
4,353,338 10/1982 Wakeman ..... 123/339
4,365,600 12/1982 Nakada et al. ..... 123/339

*Primary Examiner*—Raymond A. Nelli
*Attorney, Agent, or Firm*—Antonelli,Terry & Wands

[57] ABSTRACT

A carburetor has an apparatus for compensation of idling revolution of an internal combustion engine. The apparatus comprises a bypass passage one end of which is opened to the air suction conduit of the carburetor upstream of a throttle valve, the other end opened to the same downstream of the throttle valve. A fuel passage supplies fuel into the bypass passage to form a fuel-air mixture, a solenoid valve provided on the bypass passage for controlling a quantity of the fuel-air mixture in response to operation of a load such as, for example, heater, a radiator fan, lights, an air conditioner, etc. so that the idling rotational speed to be decreased by such operations is compensated by supplying fuel-air mixture into the air suction conduit.

9 Claims, 4 Drawing Figures

CARBURETOR WITH MEANS FOR COMPENSATION OF IDLING REVOLUTION

This invention relates to a carburetor with means for compensation of idling revolution of an internal combustion engine for an automobile.

An carburetor having a low speed fuel supply system as well as a main fuel supply system supplies fuel only through the low speed fuel supply system when an internal combustion engine is subjected to an idling operation. An amount of fuel supplied at such a time is a very little because the engine runs under substantially no load. However with an idling operation of the engine, for example, lights such as head lights are turned on an electric current of about 10 A is required, which results in reduction of the rotational speed of the engine by about 100 r.p.m. Thus, the engine, which generally idles at several hundred r.p.m., is made unstable by a sudden increase of such a load. Particularly, in the case where an air conditioner is operated, the engine has a load greatly increased, whereby the engine may stall and stop.

If the rotational speed of the engine is increased in order to compensate for loads applied, the fuel consumed, monoxides (CO) in the exhaust gas, noise, etc. also increase during an idling operation under no load conditions. Therefore, it is desireable to prevent a reduction in the rotational speed of the engine during an idling operation with loads applied to the engine while keeping the fuel supply as small as possible during the idling operation under no load conditions.

In, for example, Japanese Laid Open Patent Application No. 55-51934, an apparatus for restricting a closure of a throttle valve has been proposed which becomes effective when an air conditioner, in the inserted in the window defogger etc. are operated during an idling operation of the engine. The proposed apparatus includes a dashpot with a diaphragm for driving the throttle valve by action of vacuum applied thereto, and a solenoid valve for controlling the vacuum directed to the dashpot in response to the load.

A disadvantage of the above-noted proposed apparatus resides in the fact that it does not provide a rapid response because the dashpot supplied with vacuum drives the throttle valve against a return spring used for closing of the throttle valve. Moreover, it is difficult to precisely control the quantity of fuel-air mixture required during the idling of the engine because a sectional area of the passage in which the throttle valve is disposed is relatively large so that it is necessary to precisely control the opening degree of the throttle valve; however, such precise opening control is not easily attainable.

An object of the invention is to provide a carburetor which can rapidly compensate the idling revolution of an engine in response to a load increase, with a relatively compact construction as compared with the above-mentioned prior art.

Another object of the invention is to provide a carburetor which can rapidly and accurately compensate the revolution of an engine during the idling of the engine with a relatively compact and simple construction.

Briefly stated, the invention resides in that a fuel-air mixture, which flows into the air suction passage of a carburetor downstream of a throttle valve through passage means separated from the air suction passage is controlled by a solenoid in response to a load increase during an idling operation caused by, for example, loads such as lights for illumination, a radiator fan, electric window defoggers, air conditioners, etc, so that a quantity of the fuel-air mixture suitable for the compensation of the idling rotational speed decreased by the load increase is supplied and the idling rotational speed is compensated.

The other objects and features of the invention will be understood by the description of the preferred embodiments referring to the accompanying drawings, wherein.

Figure 1:
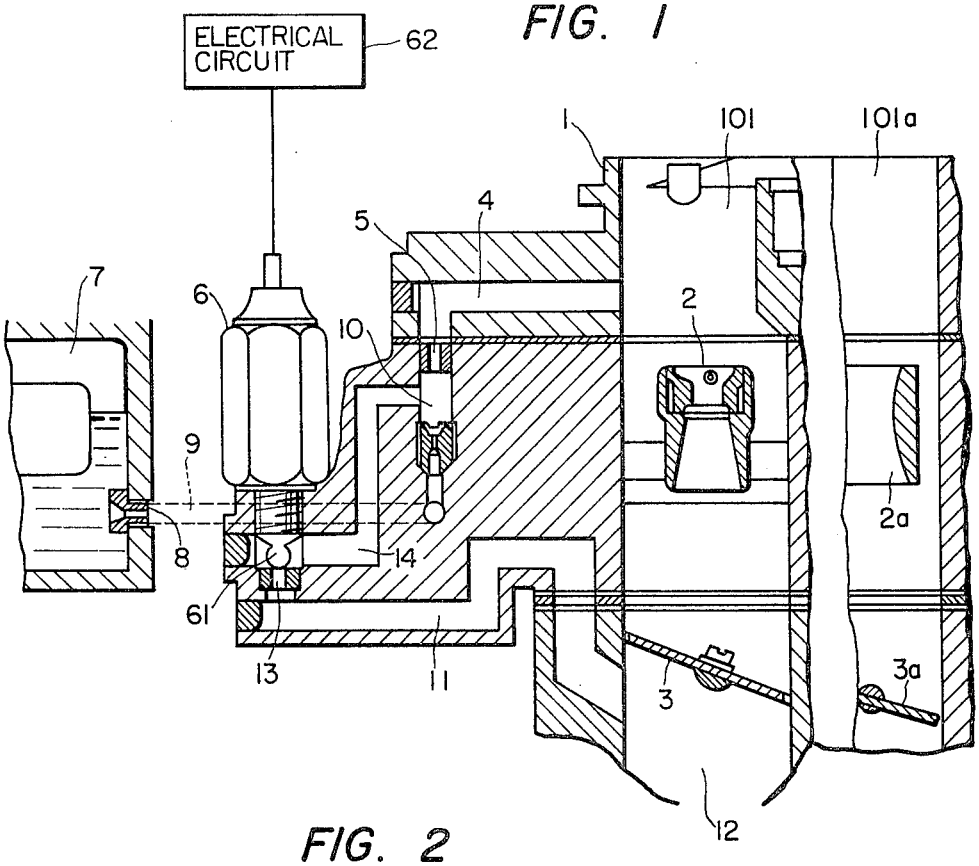
FIG. 1 is a cross-sectional view of an embodiment of a carburetor with means for compensation of idling revolution of an internal combustion engine according to the invention.

Referring now to the drawings wherein like reference numerals are used throughout the various views to designate like parts and, more particularly, to FIG. 1, according to this figure, the carburetor 1 includes a primary air suction conduit 101*a*, operational over the range of entire operating speeds of the engine (not shown) to which it is connected, and a secondary air suction conduit 101, operational only when the engine operates at high engine speeds. In the primary air suction conduit 101*a*, a Venturi 2*a*, a throttle valve 3*a*, a bypass hole and a slow hole for a low speed fuel supply system, etc. are provided. The secondary air suction conduit 101 is provided therein with a minor Venturi 2, a throttle valve 3, etc. Both the air suction conduits 101*a*, 101 are connected to the engine through an intake manifold 12. A passage 11 is formed in the body of the carburetor 1 for by-passing the minor Venturi 2 and the throttle valve 3 in the secondary air suction conduit 101. The passage 11 includes an air passage 4 and a mixture passage 14 joined to the air passage 4 on the midway of the bypass passage 11. One end of the air passage 4 opens into the suction conduit 101 at a position upstream of the small Venturi 2, with a second end portion accommodating an air bleed 5 metering an air flow. The air bleed 5 faces a fuel jet 10 communicating with a float chamber 7 through a fuel passage 9 and a main jet 8 mounted on a float chamber 7. One end of the mixture passage 14 opens into the air passage 4 between the air bleed 5 and the fuel jet 10, with a second end opening into the secondary air suction conduit 101 at a position downstream of the throttle valve 3. A solenoid valve 6 is provided in an intermediate portion of the mixture passage 14 for controlling a quantity of mixture flowing therethrough. The solenoid valve member 6 is provided with a valve 61 normally sitting on a valve seat 13 serving as an orifice for metering an amount of mixture flow. The solenoid valve 6 is electrically connected to an electrical control circuit 62 which, in turn, is electrically connected to switches to, for example, lights for illumination, an air conditioner switch, heaters, a radiator fan, etc. such that when one or all of these switches actuated, an electric signal is transmitted to the solenoid valve member 6 to open the valve 61.

During the idling of the engine, an opening degree of the throttle valve 3*a* is small so that vacuum in the intake manifold 12 is large, and the mixture passage 14 is also subjected to a vacuum because the orifice 13 is closed by the action of the solenoid valve 6. Namely, in the case of the normal idling of the engine, it is not necessary to supply a mixture of fuel and air into the engine for compensation of the revolution of the engine. In the case where one of the lights, heaters, the wiper, radiator fan, etc. is operated, the load on the engine increases resulting in a decrease in the rotational speed of the engine during the idling thereof. Upon detection of actuation of the switches, electric signals for driving the solenoid valve 6 are generated by the electric control circuit and transmitted to the solenoid valve 6, whereby the orifice 13 is opened to allow the mixture to flow into the air suction conduit 101 through the mixture passage 14. An amount of fuel supplied for compensation of the idling is, for example, 0.1 times an amount of fuel suppled during the idling without such loads.

Since, in the embodiment of FIG. 1, the load increase is detected by actuation of switches connected to various electrical apparatus or devices and the solenoid valve 6 is driven electrically, a rapid response to the load increase can be effected. The controlling apparatus for the compensation of the idling is constructed of the solenoid valve 6 and the bypass passage 11 defined by the carburetor body so that the construction is compact and simple. Further, an amount of fuel supplied for compensation is measured by the fuel jet 10 so that a precise control can be effected.

The circuit 62 for controlling the solenoid valve 6 may be such that the rotational speed of the engine is detected and when the rotational speed decreases to less than the predetermined value of, for example 600 r.p.m., electric signals are transmitted to the solenoid valve 6.

Figure 2:
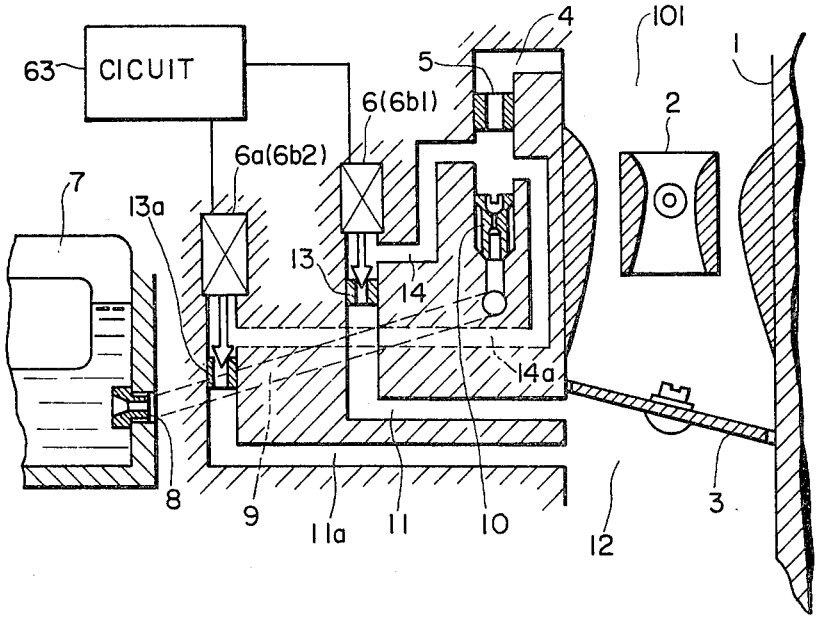
FIG. 2 is a cross-sectional view of another embodiment of a carburetor according to the invention.

As shown in FIG. 2, in addition to a mixture passage 14 and solenoid valve 6, another mixture passage 14*a* is provided and controlled by a solenoid valve 6*a*, with the mixture passage 14*a* being provided with an orifice 13*a* which is controlled by the solenoid valve 6*a*. The solenoid valve 6*a* is electrically connected to a circuit 63, with the circuit 63 controlling the solenoid valves 6, 6*a* as follows:

One or more of the switches connected to, for example, the heater, the lights, the radiator fan, the wipers, etc. are operatively associated with one of the two solenoid valves 6 while the remaining switches are operatively associated with the other solenoid valve 6*a*. Thus, for example, when the switch is connected to the the heater and lights are actuated, the solenoid valve 6 is operated to allow the mixture to flow in the mixture passage 14, whereby a suitable amount of fuel is supplied for the compensation of the idling revolution reduced by the load increase due to the heater and the lights. In the similar manner, if, for example, the switches connected to the radiator fan, window defogger, wipers, etc. are actuated, the solenoid valve 6*a* is operated to compensate for the reduction in the idling rotational speed caused by the operation of the radiator fan, the wipers, etc.

Figure 3:
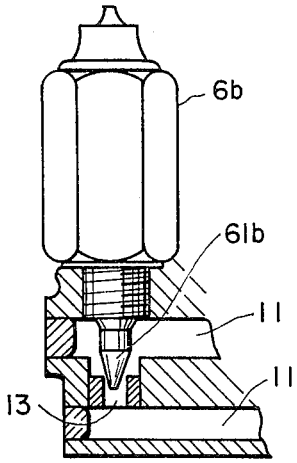
FIG. 3 is a cross-sectional view of a construction around the solenoid valve used in FIG. 2.

As shown in FIG. 3 current-stroke proportion type the solenoid valve 6*b* can be used in place of the on-off solenoid valves 6, 6*a*, with the solenoid valve 6*b* having a needle valve 61*b* adapted to be moved in proportion to a magnitude of electric control signals such as electric current to control the opening degree of the orifices 13, 13*a*. Therefore, an amount of fuel for compensation can be continuously changed.

Figure 4:
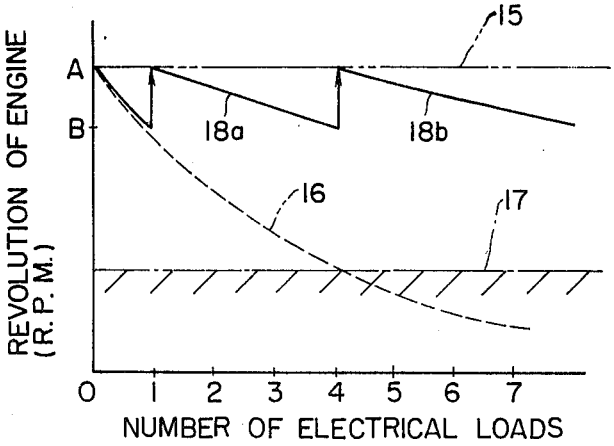
FIG. 4 is graphical illustration of a relationship between electrical loads and the idling revolution of an engine.

In FIG. 4, a line 15 denotes the rated idling rotational speed of the engine, at which the engine runs smoothly with the exhaust gas being purified by a purifying device mounted on an exhaust pipe and having therein catalyst. Under such a running condition of the engine, fuel consumption is small. A line 16 denotes a rotational speed decrease when electric loads such as lights, heater, etc. are applied. As the electric loads increase, the rotational speed of the engine decreases and the engine stops to run when the rotational speed becomes lower than a a predetermined value represented by a line 17. More particularly, as shown in FIG. 4, it is impossible to increase the number of electric loads more than five. When the rotational speed of the engine decreases to a level designated B as a result of one electric load being applied, one of the solenoid valves $6b_1$ (FIG. 2), constructed as a current-stroke proportion type valve, operates to open the orifice 13 thereby supplying fuel into the air suction conduit 101 downstream of the throttle valve 3. With the fuel supplied, the engine rotational speed can reach near a rated r.p.m. designated A. After that, until the number of electric loads increases to three, the needle valve 61*b* of the solenoid valve 6*b* is operated to extend the opening of the orifice 13 whereby an amount of fuel substantially corresponding to the load increase is supplied. When the number of electric loads reaches four, the revolution of the engine again decreases to the r.p.m. level designated at B. At the same time, the second solenoid valve 6*b*2 (FIG. 2) also operates to open the orifice 13*a* so that the engine is restored to the rated r.p.m. designated A. After then, when the number of electric loads further increase, the opening degree of the solenoid valve 6*b*1 increases to supply the necessary amount of fuel corresponding thereto. The operation change of the solenoid valves 6*b*1, 6*b*2 is depicted by the solid lines 18*a*, 18*b*. Namely, as shown in FIG. 4, the rotational speed of the idling condition of the engine can be set in the rotational speed range the rotational speed is near the rated rotational speed. Therefore, even if the electric loads are brought in during the idling of the engine, the running condition is not disturbed, whereby the fuel consumption and exhaust gas components can be maintained at a favorable level.

In the above embodiments, the apparatus for compensation of the idling rotational speed of the engine is provided for the secondary air suction conduit 101, whereby more stable compensation can be effected. The apparatus, however, can be provided for the primary air suction conduit 101*a*.

What is claimed:

1. A carburetor for an internal combustion engine of an automobile the carburetor comprising:

air suction passage means having a Venturi means therein;

throttle valve means disposed in said air suction passage means downstream of said Venturi means;

bypass passage means for bypassing said air suction passage means, said bypass passage means communicating at one end with said air suction passage means upstream of said throttle valve means and at the other end with said air suction passage means downstream of said throttle valve means;

fuel passage means for fluidly connecting a portion of said bypass passage means with a fuel source;

solenoid valve means disposed on a fuel-air mixture passage means of said bypass passage means downstream of a junction between said bypass passage means and said fuel passage means for controlling an opening of said bypass passage means in accordance with an electric load increase on the engine, so that a quantity of fuel-air mixture suitable for compensation of the idling rotational speed of the engine is supplied into said air suction passage means; and a control circuit means for detecting the electric load increase due to use of electric means installed in the automobile and for transmitting electric signals to said solenoid valve means.

2. The carburetor according to claim 1, wherein said bypass passage means includes air passage means as well as said fuel-air mixture passage means, said air passage means having an air bleed at said junction, and said fuel passage means having a fuel jet vertically opposed to said air bleed so as to ensure a sufficient mixing of fuel with air.

3. The carburetor according to claim 2, wherein said bypass passage means has a horizontally extending portion between said air bleed and said fuel jet.

4. The carburetor according to claim 1, wherein said solenoid valve means controls closure and opening of said bypass passage means.

5. The carburetor according to claim 1, wherein said air suction passage means includes a primary air suction passage and a secondary air suction passage, and both the ends of said bypass passage means are fluidly connected to said secondary air suction passage.

6. The carburetor according to claim 1, wherein said bypass passage means is defined in the carburetor body.

7. A carburetor for an internal combustion engine of an automobile, the carburetor comprising:

an air suction conduit means having at least one Venturi means provided therein;

a throttle valve means disposed in said air suction conduit means downstream of said Venturi means;

an air passage defined in a body of the carburetor, one end of said air passage being opened into said air suction conduit means upstream of said throttle valve means, a second end having an air bleed in the body of the carburetor;

a fuel passage one end of which is connected to a float chamber, a second end to a fuel jet disposed in the carburetor body so as to face said air bleed with a distance therebetween;

a mixture passage defined in the carburetor by, one end of said mixture passage being disposed between said air bleed and said fuel jet and a second end opened into said air suction conduit means downstream of said throttle valve means;

an orifice disposed in an intermediate portion of said mixture passage and serving as a valve seat;

a solenoid valve provided on said mixture passage so as to engage with said valve seat and control the opening of said orifice so that a rotational speed of the engine during idling is compensated; and a control circuit means for detecting an electric load increase due to use of electric means installed in the automobile and for transmitting electric signals to said solenoid valve.

8. A carburetor for internal combustion engines comprising:

an air suction conduit provided therein at least a Venturi means;

a throttle valve disposed in said air suction conduit downstream of said Venturi means;

an air passage defined in a body of the carburetor, one end of said air passage being opened into said air suction passage upstream of said throttle valve, the other end having an air bleed in the body of the carburetor;

a fuel passage one end of which is connected to a float chamber, the other end to a fuel jet disposed in the carburetor body so as to face said air bleed with a distance spaced therebetween;

a mixture passage defined in the carburetor body, one end of said mixture passage being disposed between said air bleed and said fuel jet and end opened to said air suction passage downstream of said throttle valve;

an orifice disposed in an intermediate portion of said mixture passage and served as a valve seat;

a solenoid valve provided on said mixture passage so as to control the opening of said orifice so that revolution during the idling of the engine is compensated;

a secondary mixture passage one end of which is opened to said mixture passage and the other end opened to said suction passage downstream of said throttle valve; a secondary orifice mounted on said secondary mixture passage; and a secondary solenoid valve provided on said secondary mixture passage so as to control the opening of said secondary orifice so that the revolution of the engine during the idling of the engine is further compensated.

9. The carburetor according to claim 7 or 8, wherein at least one of said solenoid valve and said secondary solenoid valve is of stroke-current proportional type.

* * * * *